US007782162B2

(12) United States Patent
Nishida

(10) Patent No.: US 7,782,162 B2
(45) Date of Patent: Aug. 24, 2010

(54) SWITCHING DEVICE

(75) Inventor: Takeshi Nishida, Kyoto (JP)

(73) Assignee: OMRON Corporation, Kyoto (JP)

( * ) Notice: Subject to any disclaimer, the term of this patent is extended or adjusted under 35 U.S.C. 154(b) by 120 days.

(21) Appl. No.: 12/065,996

(22) PCT Filed: Aug. 31, 2006

(86) PCT No.: PCT/JP2006/317245

§ 371 (c)(1),
(2), (4) Date: Mar. 6, 2008

(87) PCT Pub. No.: WO2007/029599

PCT Pub. Date: Mar. 15, 2007

(65) Prior Publication Data

US 2009/0134962 A1 May 28, 2009

(30) Foreign Application Priority Data

Sep. 6, 2005 (JP) ..... 2005-258106

(51) Int. Cl.
*H01H 9/30* (2006.01)

(52) U.S. Cl. ..... 335/201; 335/78; 335/83

(58) Field of Classification Search ..... 335/201, 335/78–86; 218/22–42
See application file for complete search history.

(56) References Cited

U.S. PATENT DOCUMENTS 6,853,275 B2 * 2/2005 Sato et al. ..... 335/128
7,145,422 B2 * 12/2006 Imanishi et al. ..... 335/201

FOREIGN PATENT DOCUMENTS

EP 0 095 038 A2 11/1983
JP 55-34346 3/1980
JP 59-118239 8/1984
JP 60-107550 7/1985
JP 60-107551 7/1985
JP 60-162351 10/1985
JP 62-171142 10/1987
JP 04-085529 U 7/1992
JP 08-017319 1/1996
JP 10-326553 A 12/1998
JP 11-040029 2/1999
JP 2000-340087 12/2000

OTHER PUBLICATIONS

Patent Abstracts of Japan, Publication No. 2000-340087, Publication Date: Dec. 8, 2000, 1 page.

(Continued)

*Primary Examiner*—Ramon M Barrera
(74) *Attorney, Agent, or Firm*—Osha • Liang LLP

(57) ABSTRACT

A plurality of pairs of a movable contact point and a fixed contact point, which are opposite so that they can be contacted with and separated from each other, are provided in parallel and connected in series so that an electrical current flows in the same direction between the movable contact point and the fixed contact point, which are simultaneously closed. Permanent magnets are disposed on lateral sides of the movable contact point and the fixed contact point a so that a magnetic field, which extends an arc generated between the contact points in either an upward or downward direction, is formed.

3 Claims, 15 Drawing Sheets

OTHER PUBLICATIONS

Partial English translation of JP60-107550 published Jul. 22, 1985, 1 page.
English abstract of JP11040029 published Feb. 12, 1999, esp@cenet database, 1 page.
English abstract of JP8017319 published Jan. 19, 1996, esp@cenet database, 1 page.
Partial English translation of JP55-34346 published Mar. 5, 1980, 1 page.
Partial English translation of JP60-162351 published Oct. 28, 1985, 1 page.
Partial English translation of JP62-171142 published Oct. 30, 1987, 1 page.
Partial English translation of JP59-118239 published Aug. 9, 1984, 1 page.
Partial English translation of JP60-107551 published Jul. 22, 1985, 1 page.
International Search Report issued in International Application No. PCT/JP2006/317245 mailed on Oct. 3, 2006, 2 pages.
International Preliminary Report on Patentability from PCT/JP2006/317245 dated Mar. 20, 2008 (2 pages).
English Translation of International Preliminary Report on Patentability from PCT/JP2006/317245 dated Mar. 20, 2008 (2 pages).
English Translation of Written Opinion from PCT/JP2006/317245 dated Mar. 20, 2008 (3 pages).
Patent Abstracts of Japan, Publication No. 10-326553, Publication Date: Dec. 8, 1998, 1 page.
Supplementary European Search Report for European Application No. 06797205.9-1231 dated May 15, 2009, 6 pages.
Chinese Office Action for Application No. 200680039701.X, mailed on Apr. 14, 2010 (10 pages).

* cited by examiner

SWITCHING DEVICE

TECHNICAL FIELD

The present invention relates to a switching device, in particular to a switching device suitable for a small power relay capable of opening and closing a high current and a high voltage.

BACKGROUND ART

Conventionally, as a switching device capable of opening and closing a high current and a high voltage, there is an encapsulated contact point device in which arc-extinguishing magnets are disposed (see Patent Document 1).

That is, as shown in FIGS. 1(*a*), (*b*), a pair of arc-extinguishing permanent magnets 6*a* are disposed in a front-and-back direction of fixed contact points 3*a* and movable contact point 8*c*, which are opposite so that they can be contacted with and separated from each other in an up-and-down direction.

Patent Document 1: JP2000-340087A

DISCLOSURE OF INVENTION

Problems to be Solved by the Invention

However, in the above encapsulated contact point device, it is required that the arc-extinguishing permanent magnets 6*a* be disposed between the fixed contact points 3*a*, the movable contact points 8*c* and a fixed iron core 9*c* and that they be assembled to a lower side of a movable armature 8. Therefore, the permanent magnets 6*a* cannot be retrofitted, and there are problems that assembling work takes time, assembling accuracy is low and variation in operation characteristics is liable to occur.

In view of the above problems, the present invention is to provide a switching device which is easy in assembling work, highly accurately assembled and has no variation in operation characteristics.

Means of Solving the Problem

In order to solve the above problem, in a switching device according to the present invention, it is configured that a plurality of pairs of a movable contact point and a fixed contact point, which are opposite so that they can be contacted with and separated from each other, are provided in parallel, connected in series so that an electrical current flows in the same direction between the contact points simultaneously closed, and at least one permanent magnet is disposed on a lateral side of the contact points so that a magnetic field, which extends an arc generated between the contact points in either an upward or downward direction, is formed.

EFFECT OF THE INVENTION

According to the present invention, since the permanent magnet is disposed on the lateral side of the plurality of the pairs of the contact points provided in parallel, a switching device, which can easily be retrofitted, does not take time for assembling work, is highly accurately assembled and has no variation in operation characteristics, is obtained.

In an embodiment of the present invention, the permanent magnet may be disposed on a lateral side between the adjacent plurality of the pairs of the contact points provided in parallel.

According to the present invention, in addition to the above effect, it is possible to uniformly exert a magnetic force on both sides of the adjacent contact points with one permanent magnet. Therefore, a switching device having a small number of components, high productivity and no variation in operation characteristics is obtained.

In another embodiment of the present invention, a pair of the permanent magnets may be disposed so as to face each other on both lateral sides of the plurality of the pairs of the contact points provided in parallel.

According to the present embodiment, in addition to the above effect, a much stronger magnetic field can be formed with the pair of the permanent magnets. Therefore, since it is possible to greatly extend an arc generated between the contact points in either the upward or downward direction, a switching device whose contact points have a much longer lifetime is obtained.

In a switching device according to the present invention, it is configured that a plurality of pairs of a movable contact point, which is provided on an upper end portion of a movable contact piece, and a fixed contact point, which is provided on an upper end portion of a fixed contact piece, are provided in parallel, connected in series so that an electrical current flows in the same direction between the contact points simultaneously closed, and at least one permanent magnet is disposed on a lateral side of the contact points so that a magnetic field, which extends an arc generated between the contact points in either an upward or downward direction, is formed.

According to the present invention, since the permanent magnet is disposed on the lateral side of the plurality of the pairs of the contact points provided in parallel, retrofitting is easily performed. Therefore, a switching device, which does not take time for assembling work, is highly accurately assembled and has no variation in operation characteristics, is obtained.

In the embodiment of the present invention, the permanent magnet may be disposed on a lateral side between the adjacent plurality of the pairs of the contact points provided in parallel.

According to the present embodiment, in addition to the above effect, since it is possible to uniformly exert a magnetic force on both sides of the adjacent contact points with one permanent magnet, a switching device having a small number of components, high productivity and no variation in operation characteristics is obtained.

In another embodiment of the present invention, a pair of the permanent magnets may be disposed so as to face each other on both lateral sides of the plurality of the pairs of the contact points provided in parallel.

According to the present embodiment, in addition to the above effect, a much stronger magnetic field can be formed with the pair of the permanent magnets. Therefore, since it is possible to greatly extend an arc generated between the contact points in either the upward or downward direction to extinguish it, a switching device whose contact points have a much longer lifetime is obtained.

In another embodiment of the present invention, a terminal portion of the movable contact piece and a terminal portion of the fixed contact piece, which protrude from a bottom surface of a base that supports the movable contact piece and the fixed contact piece, are connected in series with a bypass fitting so that an electrical current flows in the same direction between the contact points simultaneously closed.

According to the present embodiment, when the movable contact point and the fixed contact point are connected in series, they are connected on the bottom surface of the base partitioned from the contact points. Therefore, not only assembling work of the permanent magnet, but also connection work of the movable contact point and the fixed contact point is facilitated, so that there is an effect that a switching device with much higher productivity is obtained.

DESCRIPTION OF NUMERALS

Figure 1:
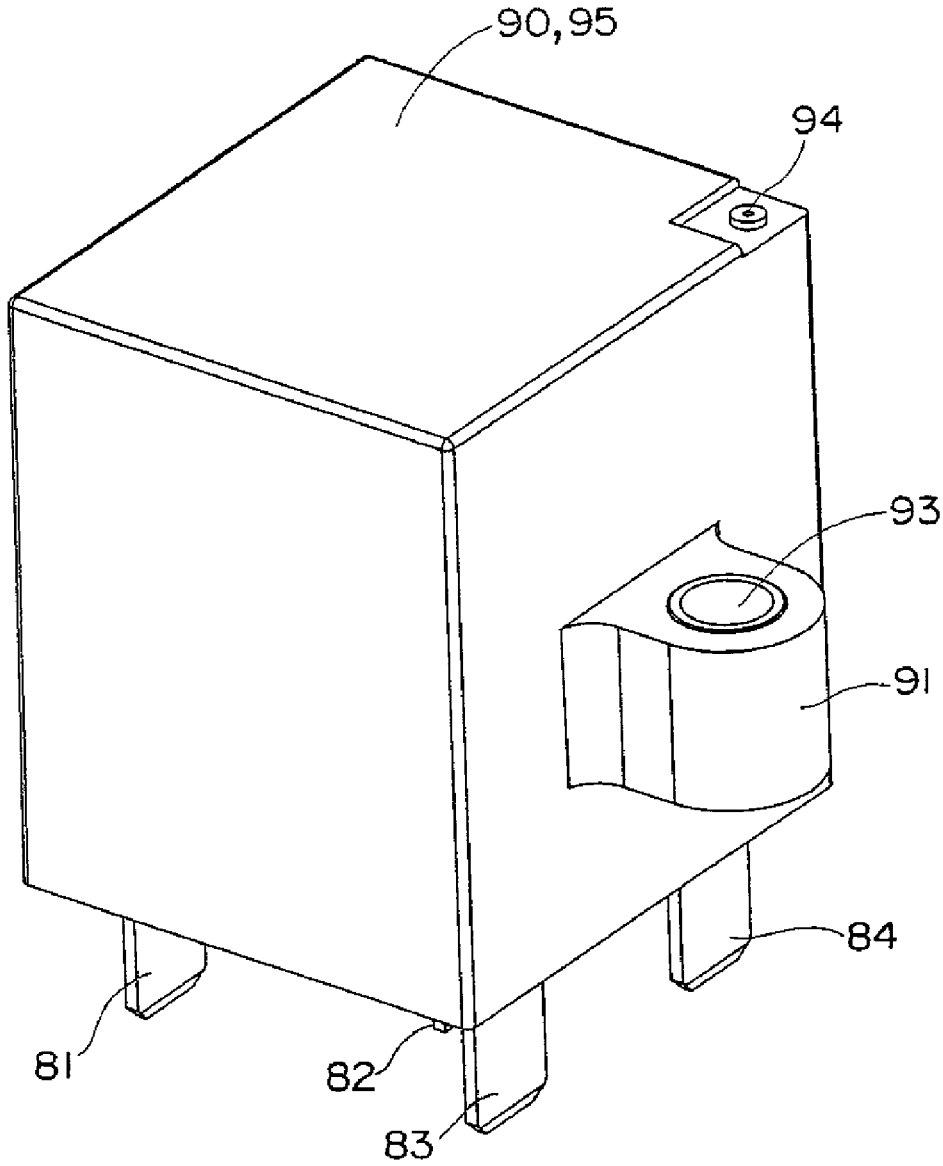
FIG. 1 is a perspective view of a power relay that is an embodiment of a switching device of the present invention.
Figure 2:
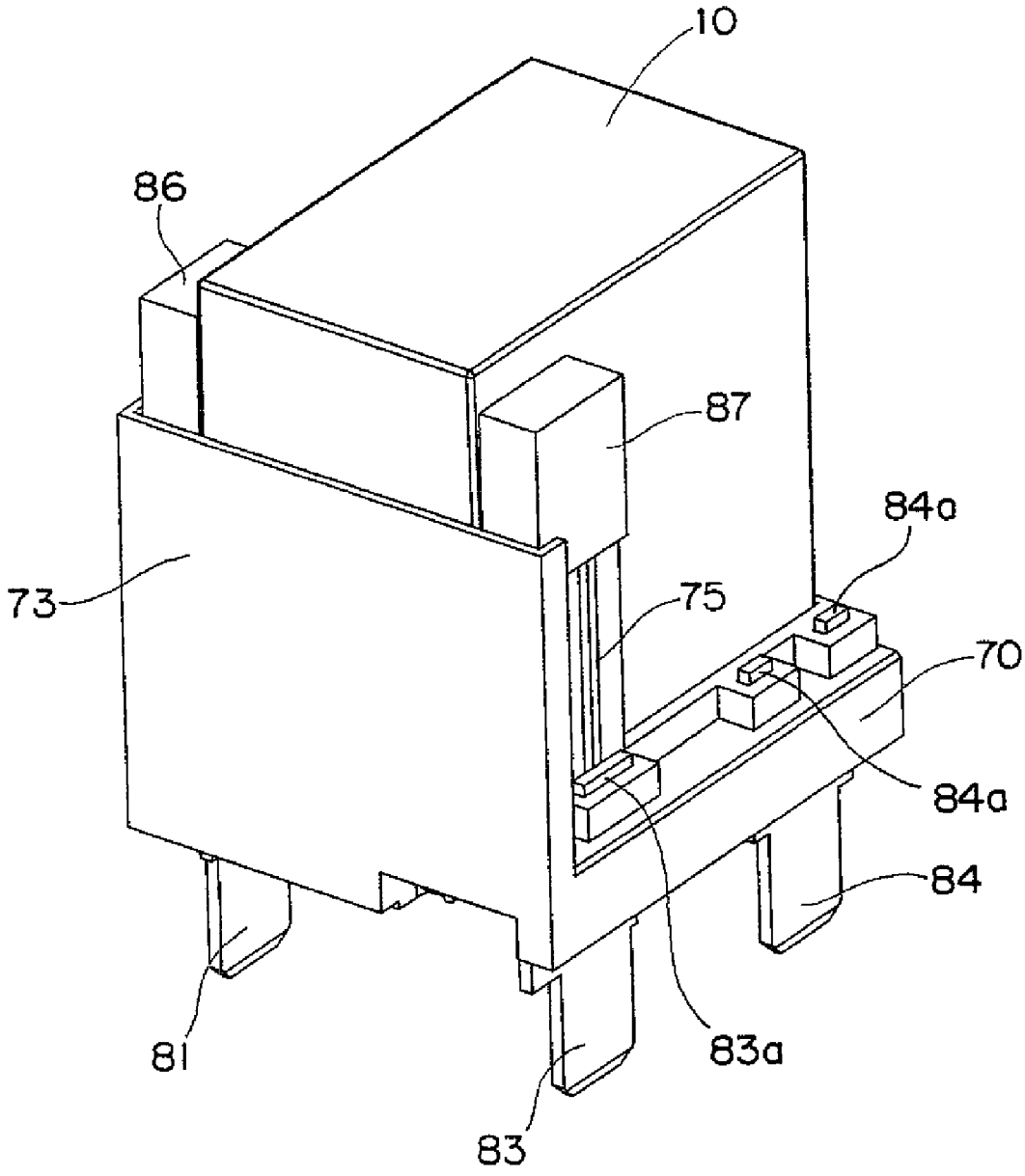
FIG. 2 is a perspective view showing a state in which an outer cover is removed from the power relay shown in FIG. 1.
Figure 3:
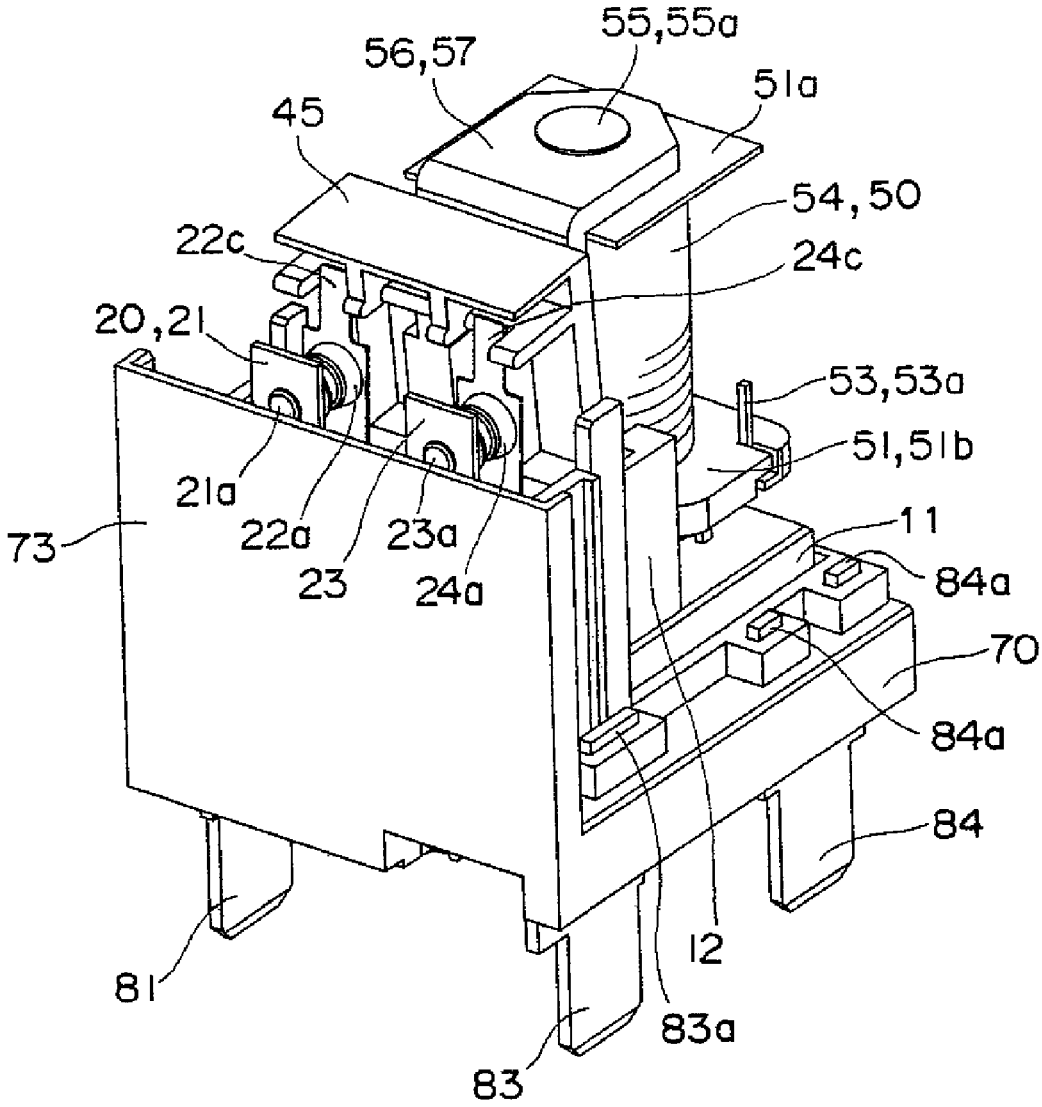
FIG. 3 is a perspective view showing a state in which an inner cover is removed from the power relay shown in FIG. 2.
Figure 4:
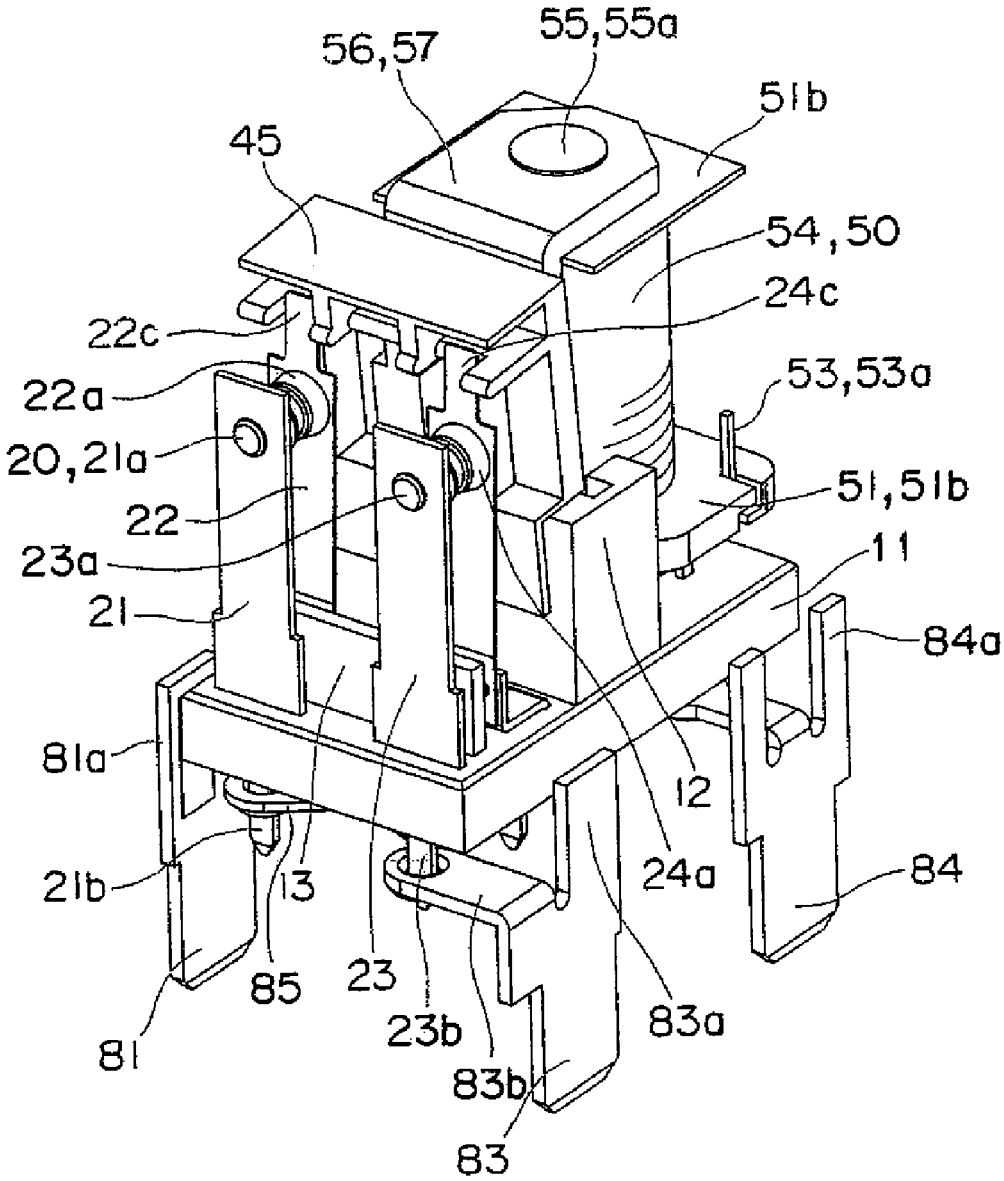
FIG. 4 is a perspective view showing a state in which an outer base is removed from the power relay shown in FIG. 3.
Figure 5:
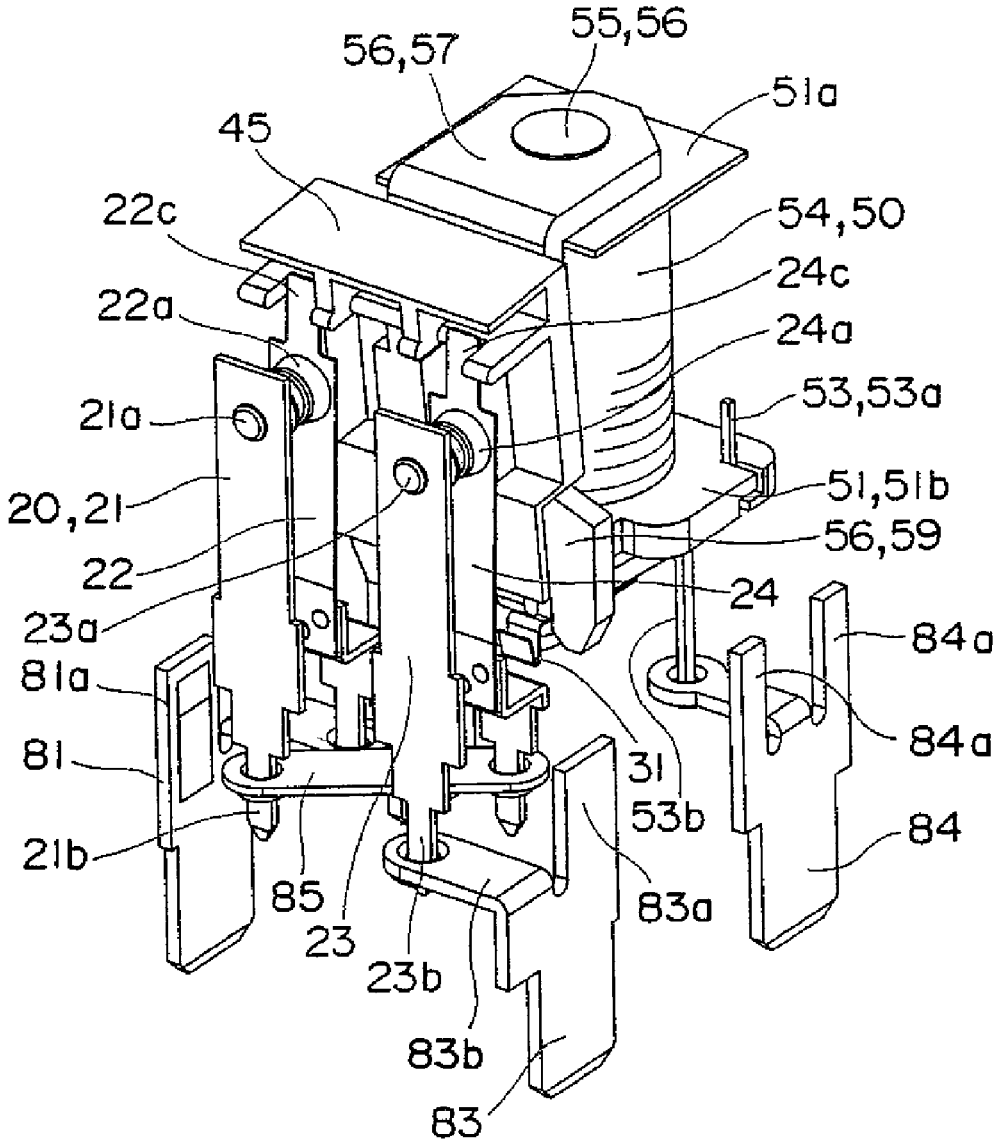
FIG. 5 is a perspective view showing a state in which an inner base is removed from the power relay shown in FIG. 4.

10: rely body
11: inner base
12: large insulating wall
13: small insulating wall
14*a*, 14*b*: terminal holes
15*a*, 15*b*: terminal holes
16: press-fitting hole
17: guide groove
20: contact point mechanism
21, 23: first, second fixed contact pieces
21*a*, 23*a*: first, second fixed contact points
21*b*, 23*b*: terminal portions
22, 24: first, second movable contact pieces
22*a*, 24*a*: first, second movable contact points
22*b*, 24*b*: terminal portions
22*c*, 24*c*: upper end portions
30: hinge spring
31: elastic pawl portion
32: central tongue piece
40: movable iron piece
41: vertical portion
42: horizontal portion
45: card
46, 47: operation recesses
48: curtain plate portion
50: electromagnetic block
51: spool
52, 53: coil terminals
52*a*, 53*a*: one end portions
52*b*, 53*b*: terminal portions
54: coil
55: iron core
55*b*: magnetic pole portion
56: yoke
60: inner cover
70: outer base
71*a*-71*d*: terminal holes
72*a*-72*d*: support holes
73: partition wall
74, 75: support walls
74*a*, 74*b*: notch portions
76: groove portion
77*a*-77*d*: seal holding recesses
81-84: tab terminals
85: bypass fitting
90: outer cover
99: seal material

BEST MODE FOR CARRYING OUT THE INVENTION

An embodiment in which the present invention is applied to a small power relay will be described with reference to accompanying drawings FIGS. 1 to 15.

Figure 8:
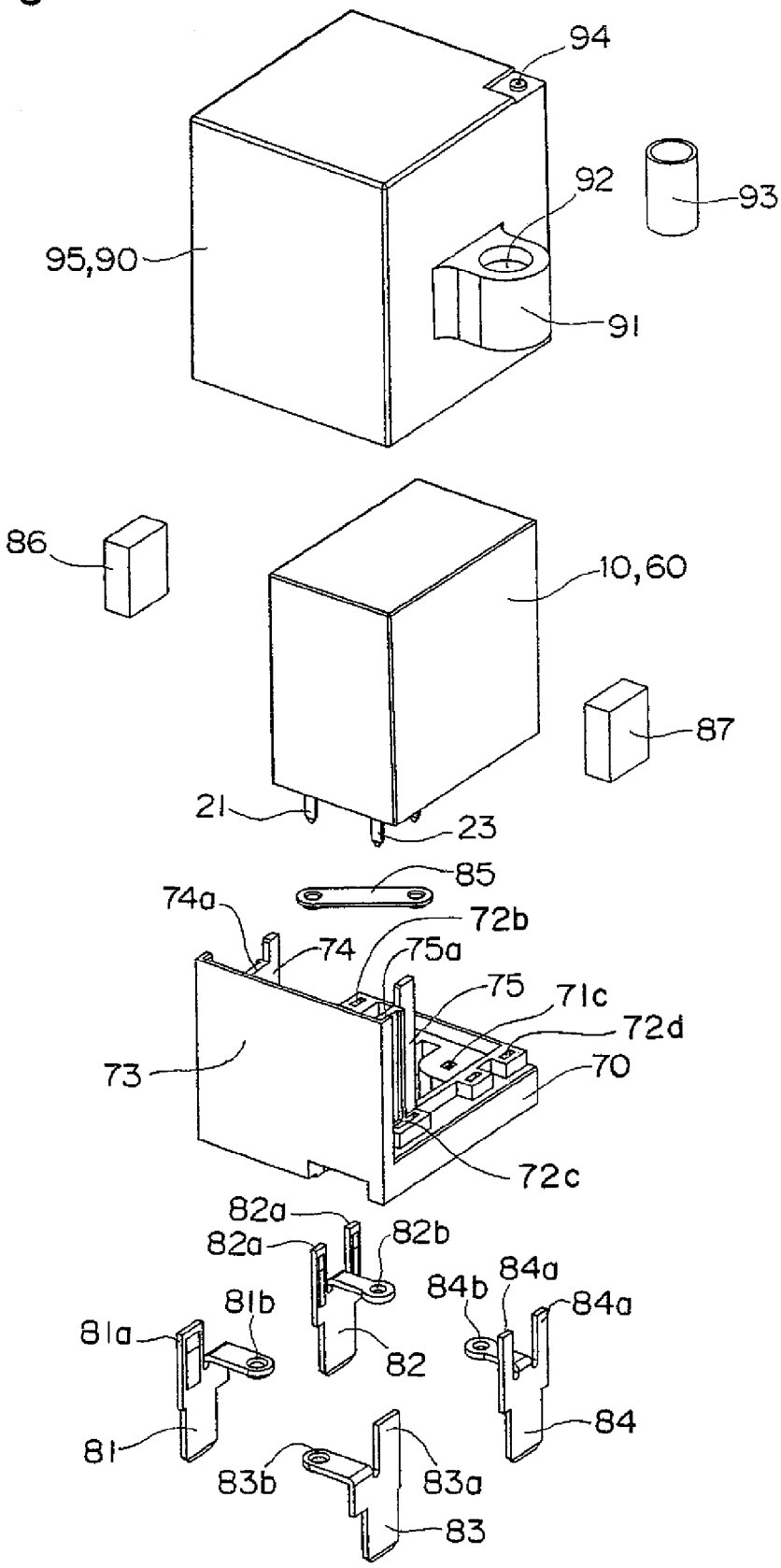
FIG. 8 is an exploded perspective view of the embodiment shown in FIG. 1.

As shown in FIG. 8, the present embodiment is a power relay in which a relay body 10 is incorporated into an outer housing 95 consisting of an outer base 70 and an outer cover 90.

Figure 14:
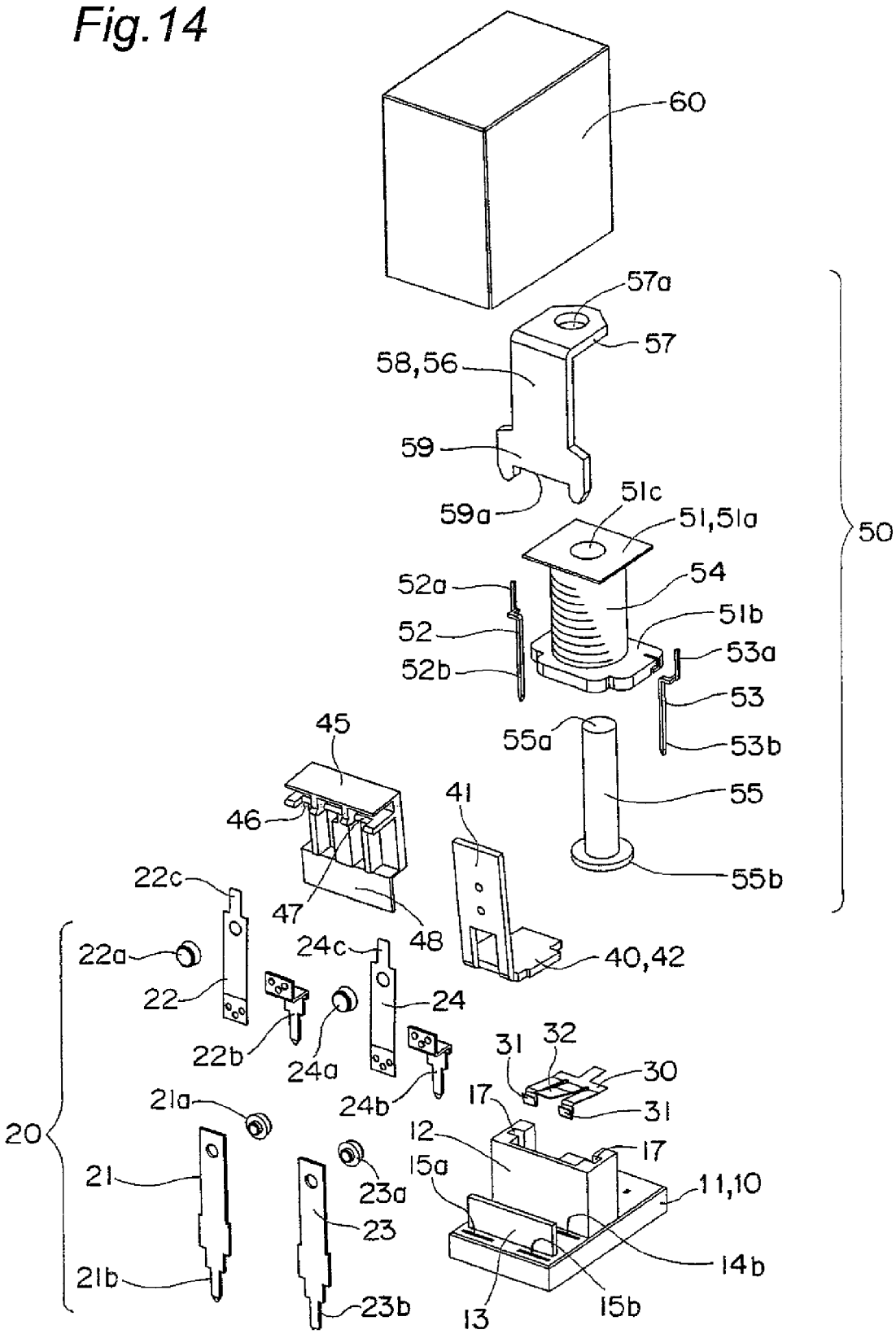
FIG. 14 is an exploded perspective view of a relay body.

As shown in FIG. 14, the relay body 10 is constructed of an inner base 11, a contact point mechanism 20, a hinge spring 30, a movable iron piece 40 provided with a card 45, an electromagnetic block 50 and an inner cover 60.

As shown in FIG. 14, a central portion of an upper surface of the inner base 11 is protrusively provided with a large insulating wall 12 generally having a C-shape in plan view, and a small insulating wall 13 is protrusively provided in proximity of a basal portion of the large insulating wall 12. Further, a pair of terminal holes 14*a*, 14*b* for movable contact pieces (the terminal hole 14*b* on the left side is not shown) are provided in parallel between the large insulating wall 12 and the small insulating wall 13. A pair of terminal holes 15*a*, 15*b* for fixed contact pieces are provided in parallel outside of a basal portion of the small insulating wall 13. Of the upper surface of the inner base 11, a portion surrounded by the large insulating wall 12 is provided with press-fitting holes 16, 16 into which generally U-shaped elastic pawl portions 31, 31 of the hinge spring 30 described below (see FIG. 6B). Then, opposite inner surfaces of the large insulating wall 12 are provided with guide grooves 17, 17 for press-fitting a broad portion 59 of a yoke 56 described below.

Figure 7:
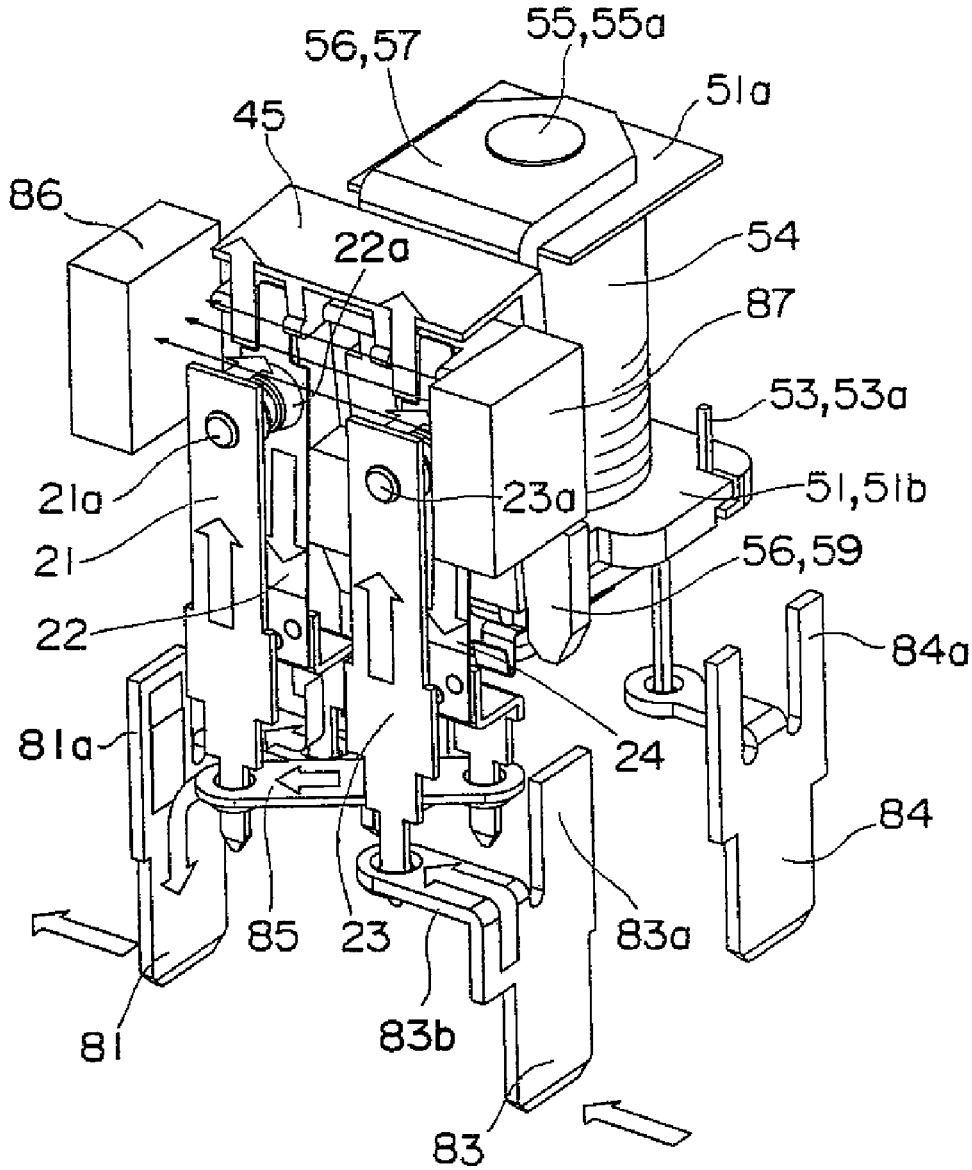
FIG. 7 is a perspective view for describing an electrical current flow and a magnetic flux flow.

The contact point mechanism 20 is constructed of a first fixed contact piece 21 to which a first fixed contact point 21*a* is fixed by caulking, a first movable contact piece 22 to which a first movable contact point 22*a* is fixed by caulking, a second fixed contact piece 23 to which a second fixed contact point 23*a* is fixed by caulking and a second movable contact piece 24 to which a second movable contact point 24*a* is fixed by caulking. As shown in FIG. 7, the first fixed contact piece 21 and the second movable contact piece 24 are connected in series with a bypass fitting 85. Therefore, the above contact point mechanism 20 has a double-break structure in which an electrical current flows in the same direction through the first fixed contact piece 21 and the second fixed contact piece 23, and the electrical current flows in the same direction through the first movable contact piece 22 and the second movable contact piece 24. Further, a pair of permanent magnets 86, 87 are provided so as to face each other on both lateral sides of the first fixed contact point 21*a*, the first movable contact point 22*a* and the second fixed contact point 23*a*, the second movable contact point 24*a*. As a result, the electrical current flows through the contact point mechanism 20, whereby an arc is generated between the contact points. Then, according to Fleming's rules, the arc is extended upward and then extinguished by a magnetic force of a magnetic field formed between the pair of the permanent magnets 86, 87. Therefore, welding and exhaustion of the contact points due to arc heat can be prevented, and there is an advantage that the contact points have an extended lifetime.

The hinge spring 30 has a generally E-shape in plan view. The generally U-shaped elastic pawls 31, 31 provided at ends of both arm portions the hinge spring 30 are press fitted into the press-fitting holes 16, 16 of the inner base 11 so as to be fixed, whereby the movable iron piece 40 described below is urged upward and rotatably supported by a central tongue piece 32 of the hinge spring 30.

Figure 15A:
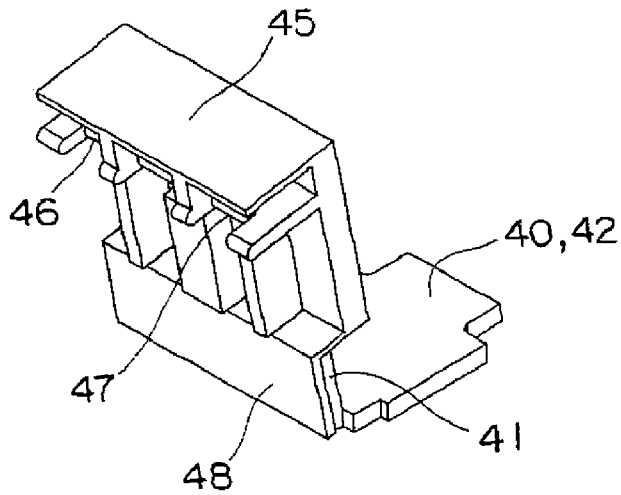
FIG. 15A and FIG. 15B are a front perspective view and a rear perspective view, respectively, which show a state in which a movable iron piece and a card shown in FIG. 14 are assembled.
Figure 15B:
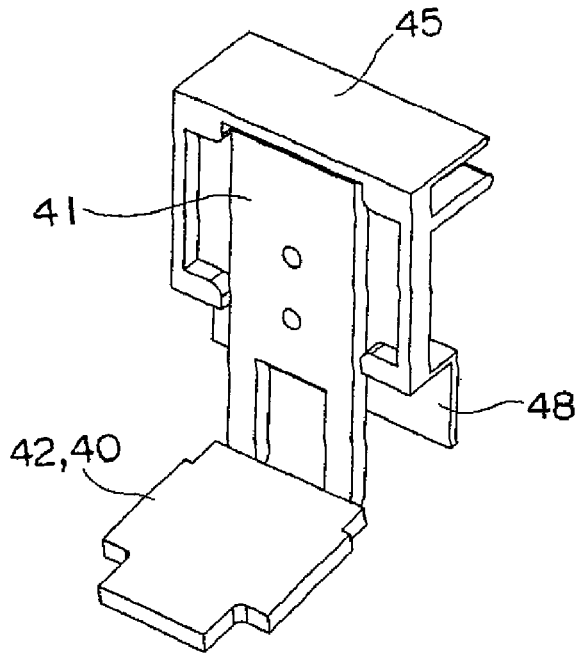

The movable iron piece 40 having the card 45 has a generally L-shape as shown in FIG. 15, and, to a vertical portion thereof, the card 45 is fixed by thermal caulking. A front surface of the card 45 is provided in parallel with operation recesses 46, 47 for pressing upper end portions 22*c*, 24*c* of the movable contact pieces 22, 24. A horizontal portion 42 of the movable iron piece 40 is placed on the hinge spring 30 fixed to the upper surface of the inner base 11, thereby being brought into press contact with the central tongue piece 32 of the hinge spring 30. Therefore, the movable iron piece 40 urged upward is rotatably supported, with a lower end portion of the yoke 56 as a fulcrum. Then, the upper end portions 22*c*, 24*c* of the movable contact pieces 22, 24 are engaged with the operation recesses 46, 47 of the card 45, thereby enabling the card 45 to press the upper end portions 22*c*, 24*c* of the movable contact pieces 22, 24.

In the present embodiment, the card 45 directly presses the upper end portions 22*c*, 24*c* of the movable contact pieces 22, 24 so as to drive them. The upper end portions 22*c*, 24*c* themselves do not generate heat. Therefore, the card 45 does not deteriorate due to heat, and operation characteristics of the relay are hardly changed. Further, since bouncing hardly occurs between the contact points, welding and abrasion of the contact points hardly occur, and there is an advantage that the contact points have a long lifetime.

In the electromagnetic block 50, of upper and lower flanges 51*a*, 51*b* provided on upper and lower end portions of a spool 51, a pair of coil terminals 52, 53 are press fitted into the lower flange 51*b*, and a leader line of a coil 54 wound on a body portion of the spool 51 is tied and soldered to one end portions 52*a*, 53*a* of the coil terminals 52, 53, and the one end portions 52*a*, 53*a* of the coil terminals 52, 53 are bent and raised up. Then, an iron core 55 having a generally T-shape in cross section is inserted into a central hole 51*c* of the spool 51, and one end portion 55*a* of the iron core 55 protruding therefrom is fixed in a caulking manner to a caulk opening 57*a* of a horizontal portion 57 of the yoke 56 that is bent in a generally L-shape. Also, the remaining other end portion serves as a magnetic pole portion 55*b*. A lower end edge portion of the broad portion 59, which is provided at a vertical portion 58 of the yoke 56, is provided with a notch portion 59*a*. Therefore, the broad portion 59 of the yoke 56 is press-fitted into the guide grooves 17, 17 of the base 11, and the notch portion 59*a* of the yoke 56 is fitted to a basal portion of a vertical portion 41 of the movable iron piece 40, whereby the electromagnetic block 50 can be fixed to the inner base 11, and the movable iron piece 40 can be rotatably supported through the hinge spring 30.

The inner cover 60, which has a box shape that can be fitted to the inner base 11, has an outer shape that can be fitted between support walls 74, 75 of an outer base 70.

Figure 9A:
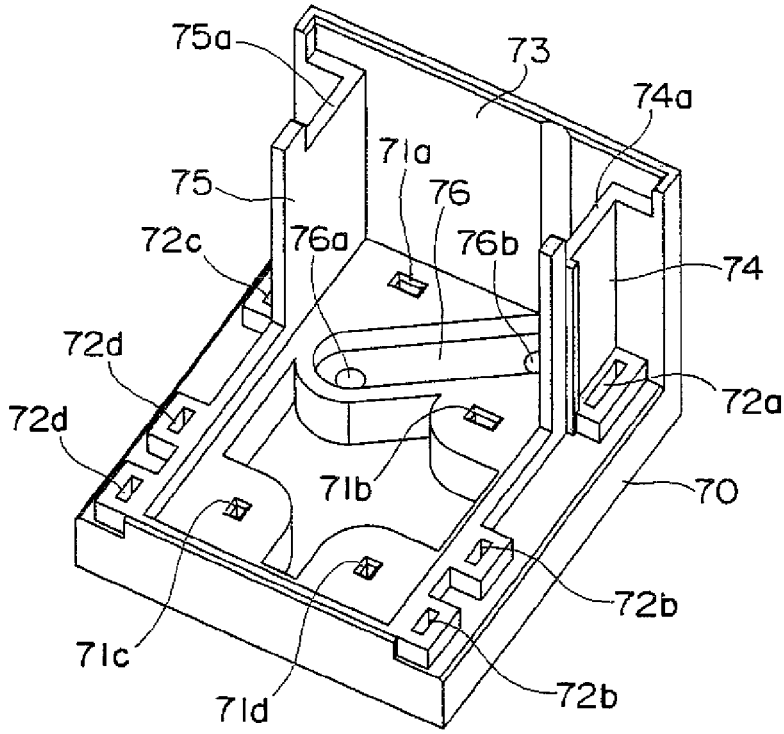
FIG. 9A and FIG. 9B are an upper perspective view and a lower perspective view, respectively, which show the outer base.
Figure 9B:
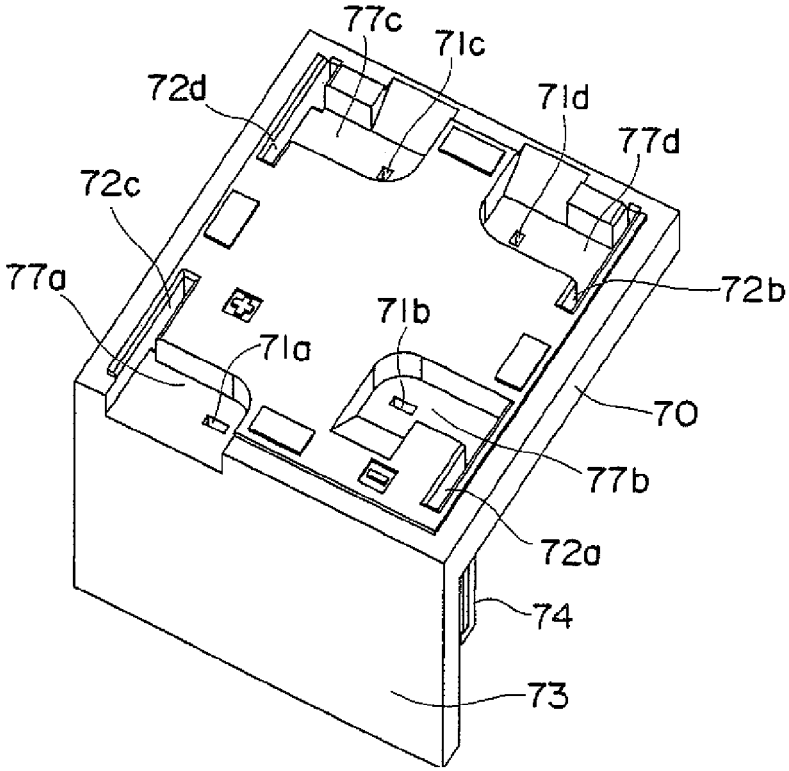

As shown in FIG. 9, the outer base 70 making up an outer housing 95 is provided with terminal holes 71*a* to 71*d* in positions corresponding to the terminals 23, 22, 53, 52, respectively, of the relay body 10. Support holes 72*a* to 72*d*, into which press fitting portions 81*a* to 84*a* of tab terminals 81 to 84 described below can be press fitted to support the tab terminals 81 to 84, are provided in both side edge portions of the outer base 70. Further, an edge portion of one end of an upper surface of the outer base 70 is protrusively provided with a partition wall 73, and both side edge portions of inward surfaces of the partition wall 73 are provided with a pair of integrally extending support walls 74, 75. Upper end edge portions of the support walls 74, 75 are provided with notch portions 74*a*, 75*b* for fitting and positioning permanent magnets 86, 87, respectively, which are described below. Of the upper surface of the outer base 70, a portion located between the support walls 74, 75 is provided with a groove portion 76 for the bypass fitting 85 to be fitted. Further, escape holes 76*a*, 76*b*, into which terminal portions 24*b*, 21*b* are fitted, are provided in both ends of a bottom surface of the groove portion 76. On the other hand, peripheries of the terminal holes 71*a* to 71*d* of a lower surface of the outer base 70 are provided with seal holding recesses 77*a* to 77*d* communicating with the support holes 72*c*, 72*a*, 72*d*, 72*b*, respectively.

As shown in FIG. 8, the outer cover 90 has a box shape that can be fitted to the outer base 70, and a reinforcing metal cylindrical body 93 is filled in a through hole 92 of an attachment portion 91 protrusively provided on a side surface of the outer cover 90. Further, a corner portion of a ceiling surface of the outer cover 90 is provided with a gas-vent opening 94.

A method for assembling the relay will be described.

First, as shown in FIG. 14, the movable contact point 22*a* is fixed in a caulking manner to an upper portion of the movable contact piece 22, to a lower end of which a movable contact point terminal portion 22*b* is fixed in a caulking manner. Similarly, the movable contact point 24*a* is fixed in a caulking manner to an upper portion of the movable contact piece 24, to a lower end of which a movable contact point terminal portion 24*b* is fixed in a caulking manner. Then, the movable contact point terminal portions 22*b*, 24*b* are press-fitted and fixed into terminal holes 14*a*, 14*b*, respectively, in the inner base 11. On the other hand, terminal portions 21*b*, 23*b* of the fixed contact pieces 21, 23, to upper ends of which the fixed contact points 21*a*, 23*a* are fixed in a caulking manner, are press-fitted and fixed into terminal holes 15*a*, 15*b*, respectively, in the inner base 11.

Subsequently, the generally U-shaped elastic pawl portions 31, 31 are positioned by being press-fitted into the press-fitting holes 16, 16 provided in proximity of the large insulating wall 12 having a generally C-shape in plan view, which is protrusively provided on the upper surface of the inner base 11. Then, the movable iron piece 40, the vertical portion of which is fixed to a back surface of the card 45, is placed on the hinge spring 30 to be positioned. Thereby, the operation recesses 46, 47 of the card 45 are engaged with the upper end portions 22*c*, 24*c* of the movable contact pieces 22, 24, respectively.

After the pair of the coil terminals 52, 53 have been press fitted and supported on the lower flange portion 51*b* of the spool 51, the leader line of the coil 54 wound on the body portion of the spool 51 is tied and soldered to the one end portions 52*a*, 53*a* of the coil terminals 52, 53, and the one end portions 52*a*, 53*a* are bent and raised vertically. Then, the iron core 55 having a generally T-shape in cross section is inserted into the central hole 51*c* of the spool 51, and the one end portion 55*a* of the iron core 55 protruding therefrom is fixed in a caulking manner to the caulk opening 57*a* of the yoke 56, which is bent in a generally L-shape in cross section. On the other hand, the other end portion that protrudes serves as the magnetic pole portion 55*b*, whereby the electromagnetic block 50 is completed.

After that, both side edge portions of the broad portion 59 of the yoke 56 are press-fitted into guide grooves 17, 17 provided in the large insulating wall 12 of the inner base 11. Thereby, the notch portion 59*a* provided at the lower end edge portion of the broad portion 59 of the yoke 56 is fitted to the basal portion of the vertical portion 41 of the movable iron piece 40, so that the central tongue piece 32 of the hinge spring 30 is pressed downward. Therefore, the movable iron piece 40 is urged upward and rotatably supported with the lower end edge portion of the yoke 56 as a fulcrum. Subsequently, by fitting the inner cover 60 to the inner base 12, the relay body 10 is completed.

Figure 10A:
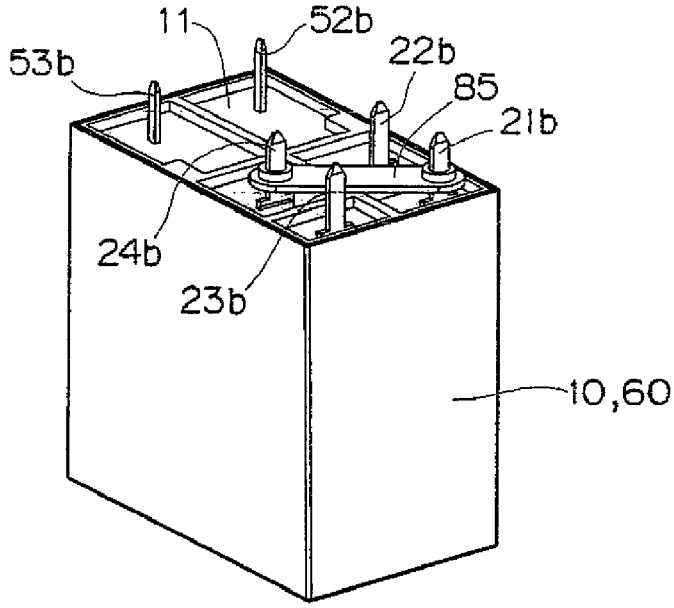
FIG. 10A and FIG. 10B are perspective views for describing a process in which a power relay is assembled from a relay body.
Figure 10B:
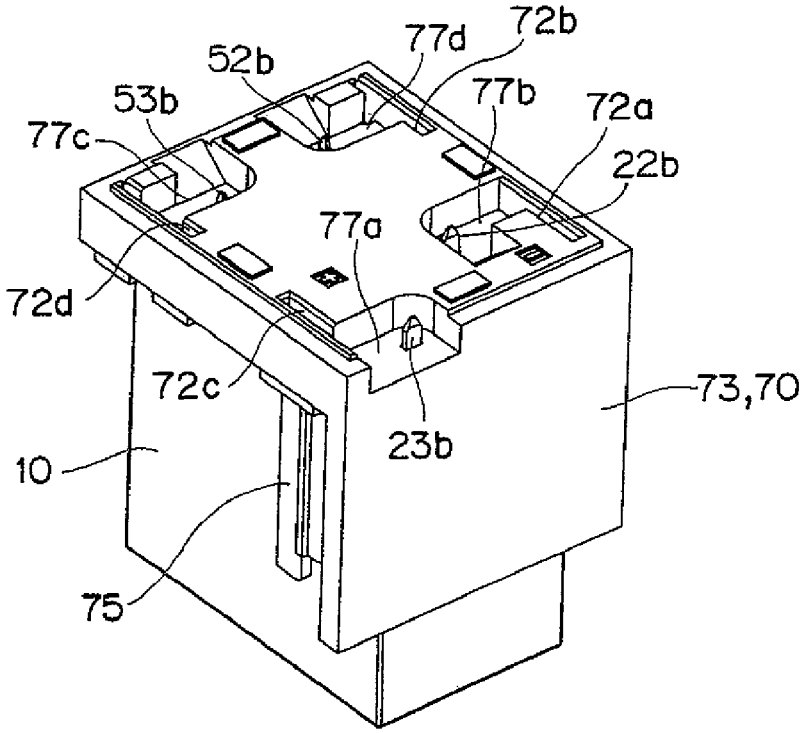
Figure 11A:
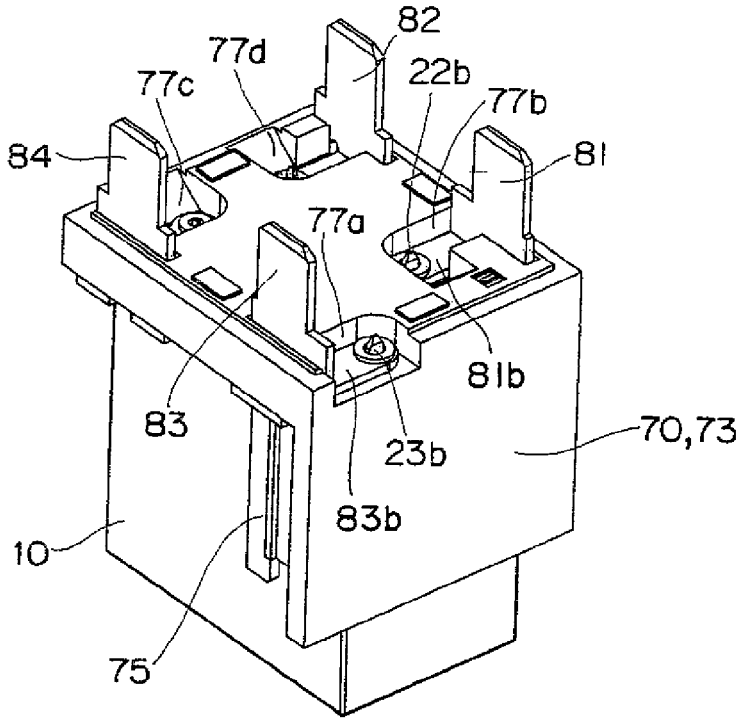
FIG. 11A and FIG. 11B are perspective views for describing a process in which the power relay is assembled from the relay body.
Figure 11B:
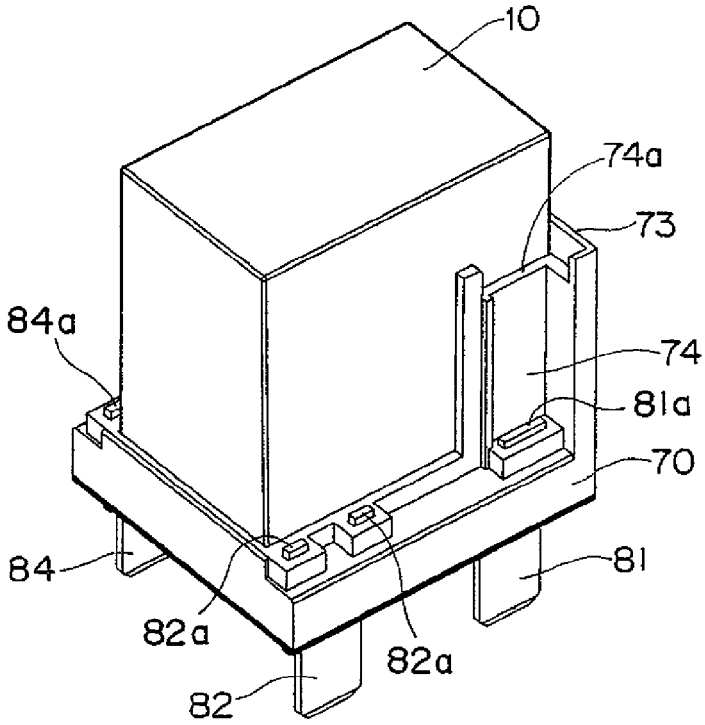

Next, as shown in FIG. 10, the terminal portion 21*b* of the first fixed contact piece 21 and the terminal portion 24*b* of the second movable contact piece 24 of the relay body 10 are connected in series with the bypass fitting 85 (FIG. 10A). Subsequently, the outer base 70 is assembled to a bottom surface of the inner base 11 (FIG. 10B). Thereby, the terminal portion 23*b* of the second fixed contact piece 23, the terminal portion 22*b* of the first movable contact piece 22, and the terminal portions 53*b*, 52*b* of the coil terminals 53, 52 are protruded from the seal holding recesses 77*a* to 77*d*, respectively. Then, the press fitting portions 81*a* to 84*a* of the tab terminals 81 to 84 are press-fitted into the support holes 72*a* to 72*d* of the outer base 70 so as to be supported. Further, connection portions 81*b* to 84*b* of the tab terminals 81 to 84 are electrically connected to the terminal portion 22*b* of the first movable contact piece 22, the terminal portion 52*b* of the coil terminal 52, the terminal portion 23*b* of the second fixed contact piece 23 and the terminal portion 53*b* of the coil terminal 53, respectively (FIG. 11A and FIG. 11B).

Figure 12A:
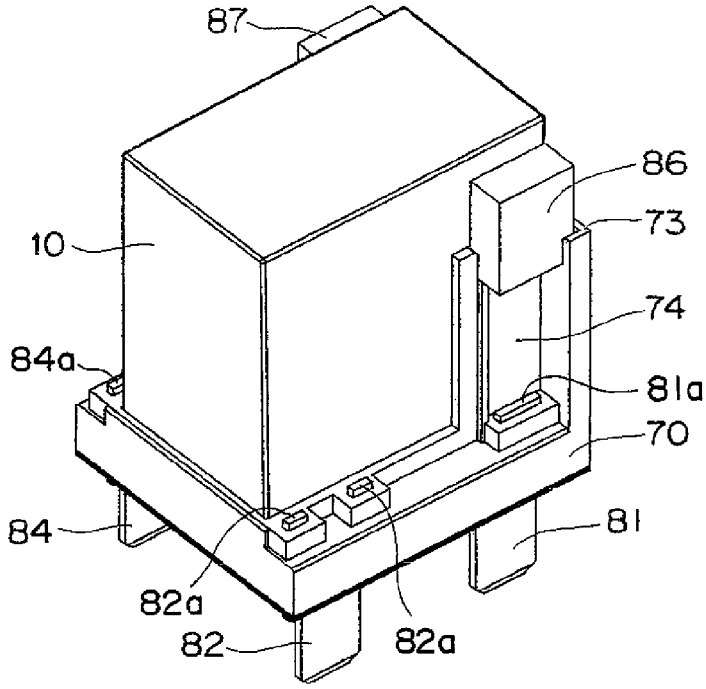
FIG. 12A and FIG. 12B are perspective views for describing a process in which the power relay is assembled from the relay body.
Figure 12B:
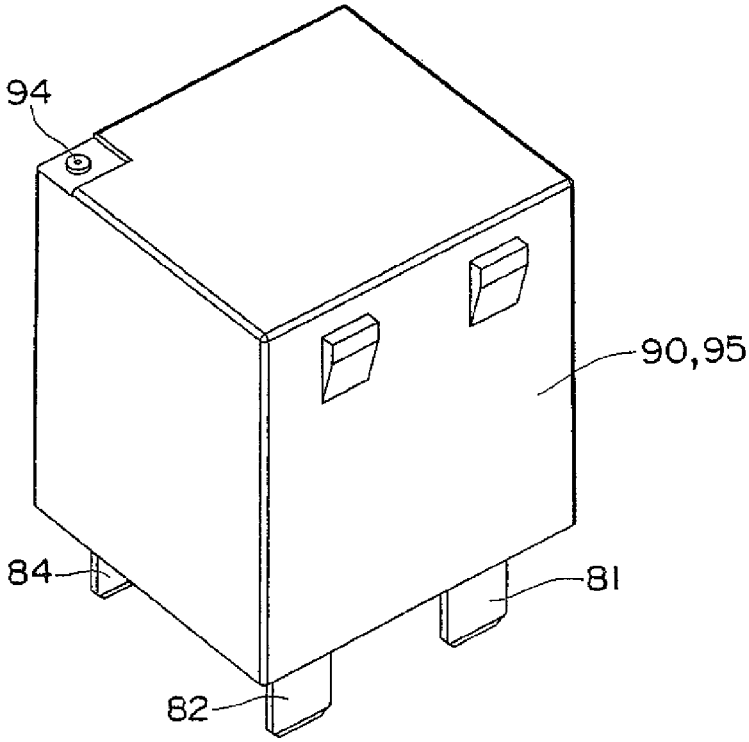
Figure 13A:
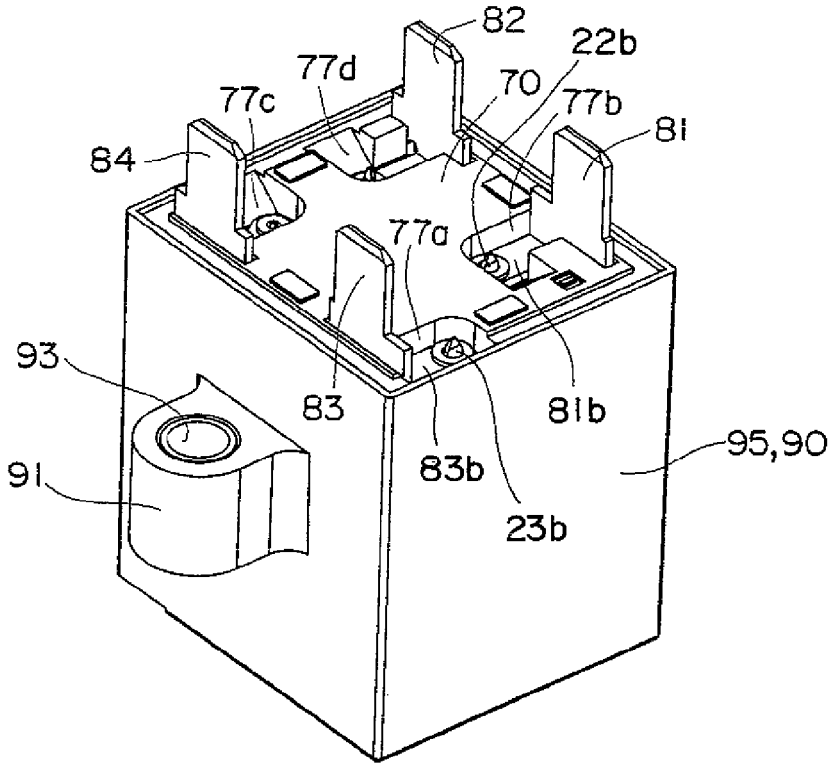
FIG. 13A and FIG. 13B are perspective views for describing a process in which the power relay is assembled from the relay body.
Figure 13B:
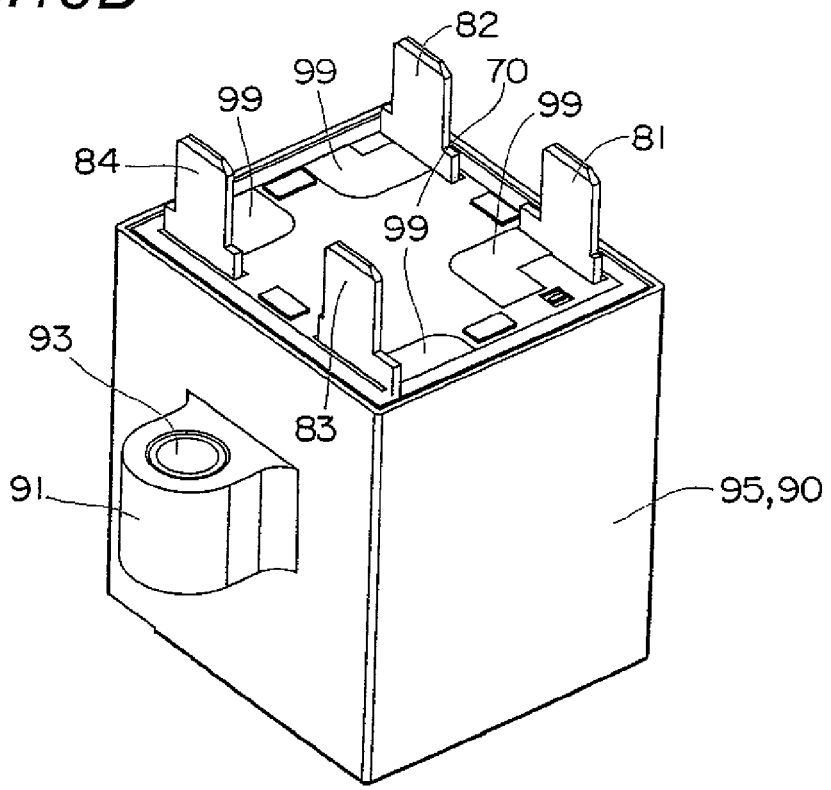

Further, as shown in FIG. 12A, the permanent magnets 86, 87 are fitted into the notch portions 74*a*, 75*b*, respectively, of the outer base 70, and fixed by an adhesive. Then, after fitting the outer cover 90 over the outer base 70, a seal material 99 is injected into the seal holding recesses 77*a* to 77*d* provided in a bottom surface of the outer base 70 to be solidified. After that, the gas-vent opening 94 is thermally sealed, whereby assembling work is completed.

According to the present embodiment, since the permanent magnets 86, 87 are placed outside the inner cover 60, a relay which is easy in assembly work, highly accurately assembled and has high productivity can be obtained.

Further, since the permanent magnets 86, 87 are partitioned from the contact point mechanism 20 by the inner cover 60, neither the contact point mechanism 20 nor the permanent magnets 86, 87 deteriorates, or is damaged due to arc heat generated in opening and closing the contact points.

Furthermore, since the contact point mechanism 20 and the like are covered with the inner cover 60 and the is outer cover 90, sound produced when opening and closing the contact points is hardly leaked, and there is an advantage that a quiet power relay is obtained.

Opening and closing operation of the small power relay with the above construction will be described.

Figure 6A:
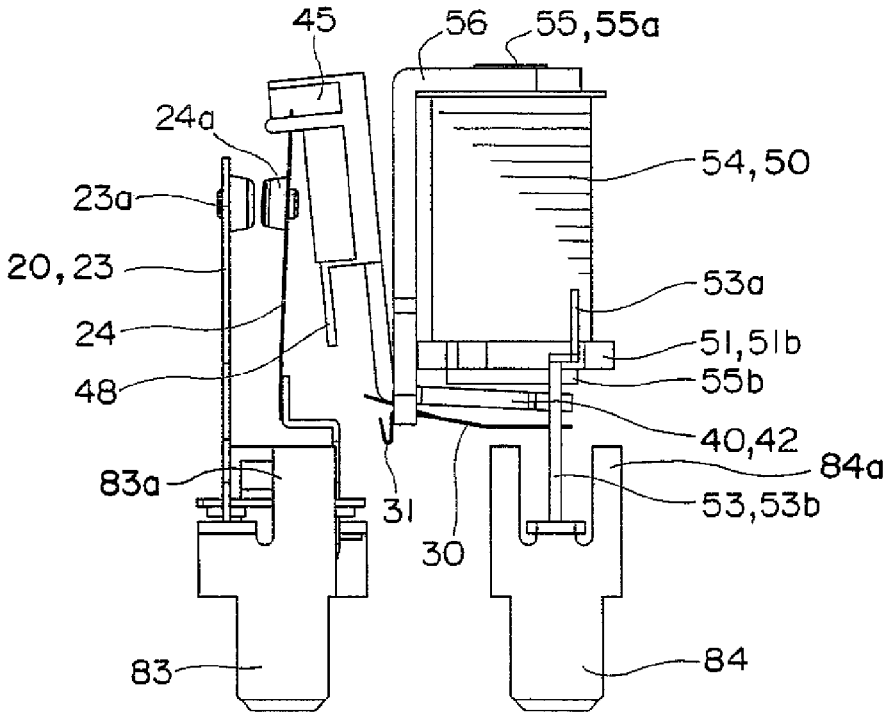
FIG. 6A is an elevational view of the power relay shown in FIG. 5.

As shown in FIG. 6, if a voltage is not applied to the coil 54 of the electromagnetic block 50, the movable iron piece 40, which is integral with the card 45 urged by a spring force of the movable contact pieces 22, 24, is rotated with the lower end edge portion of the yoke 56 as a fulcrum. Therefore, the movable contact points 22*a*, 24*a* are separated from the fixed contact points 21*a*, 23*a*, respectively, and the horizontal portion 42 of the movable iron piece 40 is separated from the magnetic pole portion 55*b* of the iron core 55.

By applying a voltage to the coil 54, the horizontal portion 42 of the movable iron piece 40 is attracted to the magnetic pole portion 55*b* of the iron core 55. Therefore, the movable iron piece 40 is rotated with the lower end edge portion of the yoke 56 as a fulcrum against the spring force of the movable contact pieces 22, 24. As a result, the card 45, which is integral with the yoke 56, presses against the upper end portions 22*c*, 24*c* of the movable contact pieces 22, 24, and after the movable contact points 22*a*, 24*a* have simultaneously come in contact with the fixed contact points 21*a*, 23*a*, respectively, the horizontal portion 42 of the movable iron piece 40 is attracted to the magnetic pole portion 55*b* of the iron core 55.

Subsequently, if voltage application to the coil 54 is stopped, the card 45 is pushed back due to the spring force of the movable contact pieces 22, 24. Therefore, the movable iron piece 40, which is integral with the card 45, is rotated with the lower end edge portion of the yoke 56 as a fulcrum, and, after the horizontal portion 42 of the movable iron piece 40 has been separated from the magnetic pole portion 55*b* of the iron core 55, the movable contact points 22*a*, 24*a* are separated from the fixed contact points 21*a*, 23*a* so as to recover to the original state.

According to the present embodiment, when the movable contact points 22*a*, 24*a* are simultaneously separated from the fixed contact points 21*a*, 23*a*, respectively, even if an arc is generated between the opposite contact point surfaces, according to Fleming's rules, the arc is extended upward and extinguished by the magnetic force of the magnetic field formed by the permanent magnets 86, 87. Therefore, the temperature of the contact point surfaces is not increased, welding and exhaustion of the contact points hardly occur, and thus there is an advantage that the contact points have an extended lifetime.

Figure 6B:
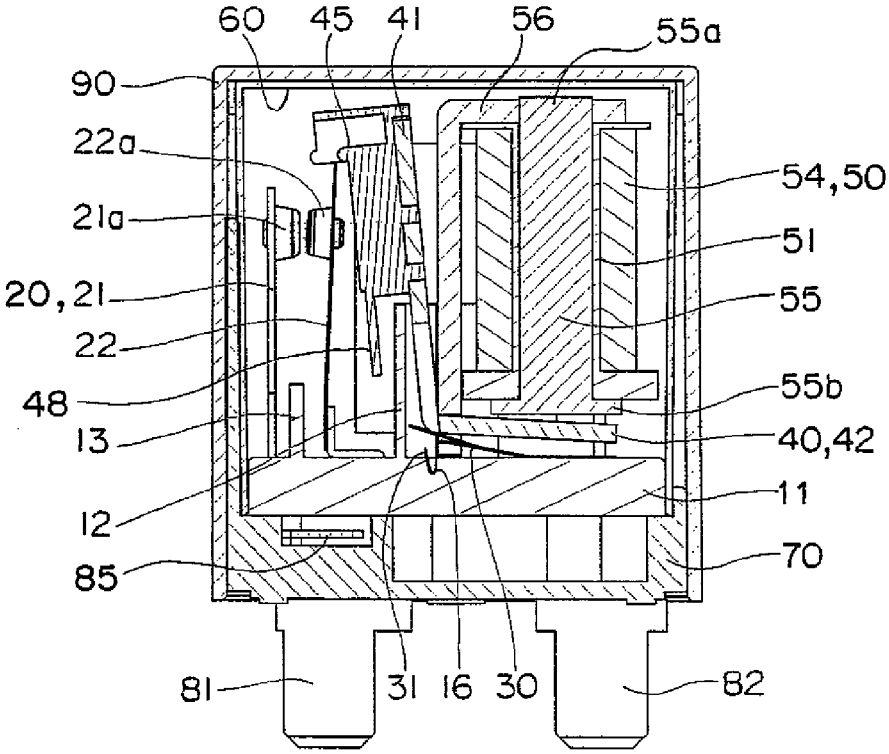
FIG. 6B is a longitudinal cross sectional view of the power relay shown in FIG. 1.

Further, according to the present embodiment, as shown in FIG. 6B, the small insulating wall 13 is protrusively provided between a basal portion of the movable contact pieces 22, 24 and a basal portion of the fixed contact pieces 21, 23, and a curtain plate portion 48 of the card 45 and the large insulating wall 12 overlap each other. Therefore, the creepage distance is long and there is an advantage that the insulation properties are good.

Further, in the present embodiment, although the terminal portions 22*b*, 24*b* of the movable contact pieces 22, 24 are bent, those portions which are directly rotated are straight. Therefore, the manufacture is easy, compared with conventional movable contact pieces with their driving portions are complicatedly bent, so that high component accuracy and assembling accuracy are ensured, and there is an advantage that variation in operation characteristics does not occur.

In the above embodiment, the case where a double pole relay is utilized as a double break structure was described, and, utilizing a triple pole relay, for example, the relay may also be assembled so as to have a triple break structure.

Further, by providing in parallel a plurality of single pole relays, and connecting them in series, a switching device may be manufactured in the same manner as in the above embodiment. Furthermore, a single pole relay and a triple pole relay are provided in parallel, and connected in series to manufacture a switching device.

In the above embodiment, the case where the permanent magnets are provided on both the lateral sides of the plurality of the pairs of the contact points provided in parallel was described, but it is not necessarily limited thereto. Of the plurality of the pairs of the contact points that are opposite to each other, the permanent magnet may be disposed between the adjacent contact points. For example, three single pole relays are provided in parallel, connected in series and the permanent magnets are disposed one by one on a lateral side of adjacent contact points.

INDUSTRIAL APPLICABILITY

The switching device of the present invention can be applied not only to the small power relay mentioned above, but also to other relays.

The invention claimed is:

1. A switching device wherein a plurality of pairs of a movable contact point, which is provided on an upper end portion of a movable contact piece, and a fixed contact point, which is provided on an upper end portion of a fixed contact piece are provided in parallel connected in series so that an electrical current flows in the same direction between the contact points simultaneously closed, and at least one permanent magnet is disposed on a lateral side of the contact points so that a magnetic field, which extends an arc generated between the contact points in either an upward or downward direction, is formed, wherein a terminal portion of the movable contact piece and a terminal portion of the fixed contact piece, which protrude from a bottom surface of a base that supports the movable contact piece and the fixed contact piece, are connected in series with a bypass fitting so that an electrical current flows in the same direction between the contact points simultaneously closed.

2. A switching device wherein a plurality of pairs of a movable contact point, which is provided on an upper end portion of a movable contact piece, and a fixed contact point, which is provided on an upper end portion of a fixed contact piece are provided in parallel connected in series so that an electrical current flows in the same direction between the contact points simultaneously closed, and at least one permanent magnet is disposed on a lateral side of the contact points so that a magnetic field, which extends an arc generated between the contact points in either an upward or downward direction, is formed, wherein the permanent magnet is disposed on a lateral side between the adjacent plurality of the pairs of the contact points provided in parallel, and wherein a terminal portion of the movable contact piece and a terminal portion of the fixed contact piece, which protrude from a bottom surface of a base that supports the movable contact piece and the fixed contact piece, are connected in series with a bypass fitting so that an electrical current flows in the same direction between the contact points simultaneously closed.

3. A switching device wherein a plurality of pairs of a movable contact point, which is provided on an upper end portion of a movable contact piece, and a fixed contact point, which is provided on an upper end portion of a fixed contact piece are provided in parallel connected in series so that an electrical current flows in the same direction between the contact points simultaneously closed, and at least one permanent magnet is disposed on a lateral side of the contact points so that a magnetic field, which extends an arc generated between the contact points in either an upward or downward direction, is formed, wherein a pair of the permanent magnets are disposed so as to face each other on both lateral sides of the plurality of the pairs of the contact points provided in parallel, and wherein a terminal portion of the movable contact piece and a terminal portion of the fixed contact piece, which protrude from a bottom surface of a base that supports the movable contact piece and the fixed contact piece, are connected in series with a bypass fitting so that an electrical current flows in the same direction between the contact points simultaneously closed.

* * * * *